United States Patent [19]

Jauch

[11] Patent Number: 4,908,807

[45] Date of Patent: Mar. 13, 1990

[54] MECHANICAL INTERVAL TIMER WITH CALIBRATION MEANS

[75] Inventor: Christian M. Jauch, Hewitt, N.J.

[73] Assignee: Sunbeam Corporation, Downers Grove, Ill.

[21] Appl. No.: 346,422

[22] Filed: May 1, 1989

Related U.S. Application Data

[62] Division of Ser. No. 544,651, Oct. 24, 1983, Pat. No.

[51] Int. Cl.[4] ..... G04F 1/00

[52] U.S. Cl. ..... 368/89; 368/97; 368/98; 368/324

[58] Field of Search ..... 368/89, 97–99, 368/101, 324–326; 24/20; 29/159.2, 177, 178, 407

[56] References Cited

U.S. PATENT DOCUMENTS

| | | | |
|---|---|---|---|
| 2,656,672 | 10/1953 | Webber | 368/99 |
| 2,667,736 | 2/1954 | Kiel | 368/99 |
| 3,555,809 | 1/1971 | Michael | 368/99 |

*Primary Examiner*—Vit W. Miska
*Attorney, Agent, or Firm*—Neil M. Rose

[57] ABSTRACT

A mechanical interval timer and method of manufacturing same including an adjustable bearing permitting adjustment of the space between the escape wheel and the escape lever disc to obtain an accurate timing rate through precalibration of one sample made from a selected group of parts for the timer.

7 Claims, 2 Drawing Sheets

MECHANICAL INTERVAL TIMER WITH CALIBRATION MEANS

This is a division of application serial No. 544,651, filed Oct. 24, 1983, now U.S. Pat. No. 4,849,951.

BACKGROUND OF THE INVENTION

This invention relates to mechanical interval timers designed for domestic or household use. Such timers are employed in the kitchen and are usually intended to time intervals of between one and sixty minutes. Such timers are driven by a spring which is initially tensioned, and the prescribed time interval to be timed is set by simply rotating a pointer or index mechanism from zero to the desired number of minutes, which rotation further tensions the spring. This spring then drives, through a gear train, an escape wheel which is permitted to rotate at a controlled speed by an escape lever disc which oscillates in and out of obstructing relationship with the escape wheel. The escape wheel is a toothed member which rotates adjacent the escape lever disc. A pair of posts on the escape lever disc oscillate into and out of engagement with the teeth on the escape wheel thereby permitting the gear train to unwind until it returns to the zero setting at which time a bell is normally sounded.

It is well-known in the art to provide means for adjusting the rate of movement of the escape wheel by varying the distance between the axes of the escape wheel and the escape lever disc. As the distance between these axes is reduced, the escape wheel is caused to rotate more slowly and, conversely, when the distance is increased, the escape wheel rotates more rapidly.

It had been well-known in the prior art to provide one of the metallic frame members which supported the escape lever disc with a deformable portion which would permit repositioning the bearing for the escape lever disc in order to recalibrate the movement. This calibration was done on an individual basis for each movement.

It has become common in the timer art to utilize plastic gears rather than the stamped or die cast gears which had formerly been used. Although plastic gears can be dimensioned very accurately, there are variations resulting from different mold cavities and the like which tend to provide dimensional differences which were not common in the metal gears. Accordingly, there have been increased needs to calibrate timers which have been made with plastic gears. However, due to the intense price competition in the low-cost mechanical timer field, it is not feasible to calibrate each individual timer. By means of the method and apparatus of my invention, it is possible to produce an accurate low-cost interval timer without calibrating each individual unit.

BRIEF SUMMARY OF THE INVENTION

The invention is applicable to low-cost mechanical timer movements in which molded plastic parts are employed. The timer is designed with an adjustable bearing for the escape lever disc whereby the distance between the axes of the escape lever disc and the escape wheel may be adjusted to calibrate the timer. By selectively grouping the parts which are used in the production of the timer, it is possible to obtain relatively standard sets of parts which are substantially identical to each other. By calibrating one of the timers made with these selected groups of parts, it is possible to establish the optimum spacing of the escape lever disc and the escape wheel to provide accurate interval timing. Once this distance has been established, it is correlated with the rotary position of the eccentric bearing which mounts the escape lever disc. Thereafter, for the rest of the timers made using this particular set of selected groups of parts, the bearing is inserted in a rotary position so as to achieve the desired spacing of the axes.

At the same time, the timer is designed so that when the timer movement is assembled in its housing, the bearing which provided the factory calibration is still exposed so that it may provide a consumer adjustment if the timer, as a consequence of wear or aging, needs to be recalibrated.

The face of the timer housing is provided with a circular recess within which the indicia for indicating the time intervals are applied. The indicia are then covered and protected by the time set indicator which comprises a transparent disc fitted into the circular recess and overlying the indicia. The time set indicator has a knob portion extending diametrically across the face of the disc to permit easy adjustment. There is also a magnifying area in which a radial line is provided to permit precise setting of the indicator with respect to the indicia on the housing.

It is an object of the present invention to provide an improved mechanical timer and an improved process for manufacturing such a timer.

It is a further object of the present invention to provide a method of manufacturing a series of interval timers by calibrating one made with a grouped set of parts and applying that calibration information to the manufacture of the other timers made with said parts.

Another object of the present invention is to provide a mechanical timer with a calibration means including an adjustable bearing which may be assembled to the plastic movement so that a preselected spacing is obtained between the escape wheel axis and the escape lever disc axis.

Further objects and advantages will become apparent as the following description proceeds and the features of novelty which characterize the invention will be pointed out in the claims annexed to and forming a part of the specification.

DESCRIPTION OF THE PREFERRED EMBODIMENT

Figure 1:
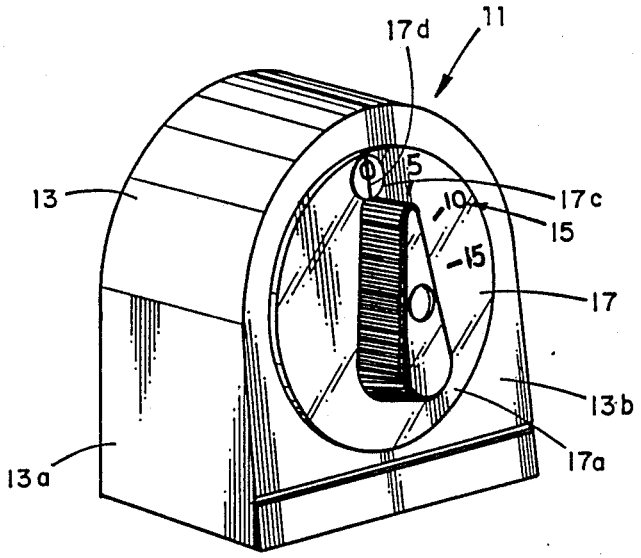
FIG. 1 is a perspective view of a mechanical interval timer embodying my invention.

Referring to the drawings, there is shown in FIG. 1, a timer designated generally by reference numeral 11. The timer 11 includes a somewhat cup-shaped decorative housing member 13 which has side walls **13*a*, a front wall 13*b* and a rearwardly facing opening 13*c***. On the front wall 13*b* of the housing member 13, there is formed a circular recess or depression 13*d* within which minute indicia 15 are stamped on the face of the housing member 13. Typically, there would be radial lines to indicate each minute and numerals at each five minute interval as shown in part in FIG. 1 with the entire circumference representing sixty minutes.

Received within the recess 13*d* and overlying the indicia 15, is a time set indicator 17 which is made up of a transparent circular disc 17*a* and a manual actuator or knob 17*b* which extends diametrically across the face of the disc 17*a*. The knob 17*b* permits the user to adjust the indicator 17 to the time interval which is to be timed out by the timer 11.

To facilitate setting the timer, at the zero indicating position, there is a circular magnifying lens 17c molded as part of the transparent disc 17*a*. The lens 17*c* has a radial line 17*d* inscribed thereon to permit precise setting of the indicator 17.

The timer 11 further includes a movement 20 which is secured to the inside of the front wall 13*b* of the housing member 13. The front wall 13*b* is formed integrally with a plurality of rearwardly extending support bosses 13*e* to which the movement 20 is secured by screws or the like. The enclosure for the movement 20 is completed by a conventional cup-like bell member 22 which is secured to the movement 20 by a spring retainer 24 received on a boss 26 extending from the movement 20. A striker on the movement impacts the bell member 22 at the end of the timed interval to produce an audible signal.

Figure 3:
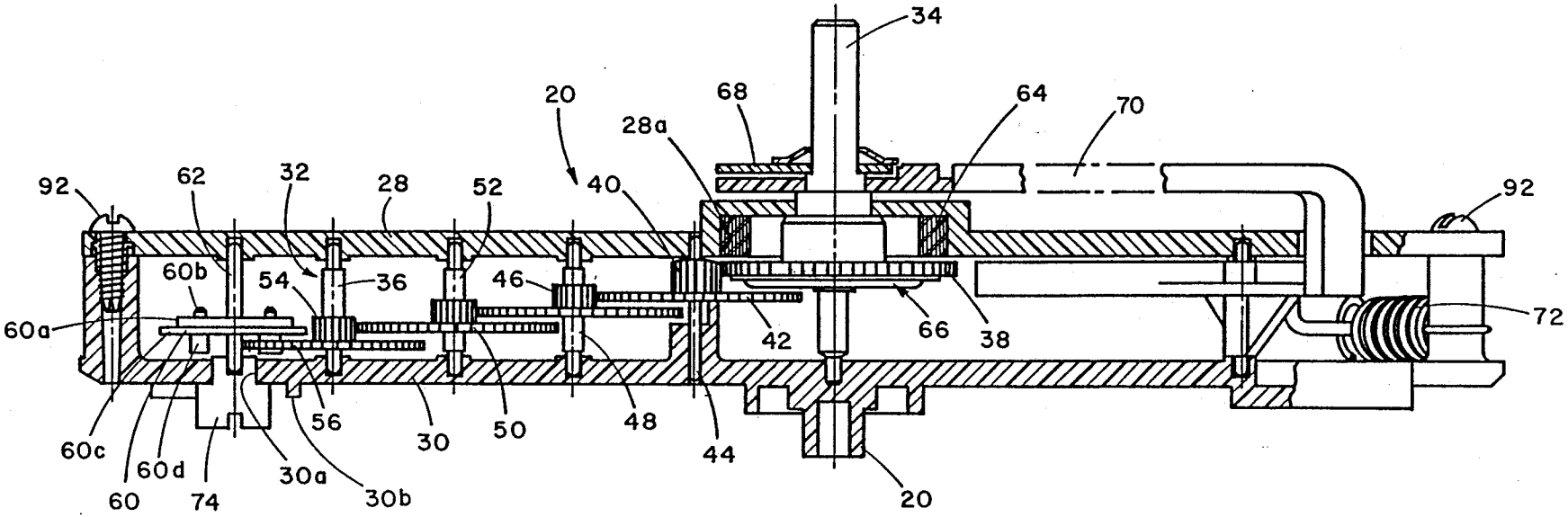
FIG. 3 is a somewhat schematic showing of the movement of the interval timer shown in section.

The specific configuration of the movement 20 forms no part of the instant invention, it being understood that the gear train associated with a mechanical timer of this type may be organized in any desired manner to fit into a particular space. In FIG. 3, the sectional view of the gearing is shown schematically with the axes of all the gears disposed in the plane of the paper. It should be understood, however, that in actual practice, the axes of the various gears would be grouped in a circle around the central axis so as to provide the most compact arrangement. The movement 20 includes a front frame member 28 and a rear frame member 30 between which an escapement gear train designated generally by the reference numeral 32 is disposed. The gear train 32 is intended to drivingly interconnect a main set shaft 34 with the escape shaft 36. Included in this gear train 32 is a spur gear 38 mounted on the set shaft 34 which drives a pinion 40 formed integrally with a gear 42 and mounted on a shaft 44. The gear 42 drives a plastic pinion and gear 46 carried by a shaft 48 which in turn drives a plastic pinion and gear 50 supported on a shaft 52. The output of pinion and gear 50 drives a plastic pinion 54 which is formed integrally with escape wheel 56 and its supporting shaft 36. The rotation of the gear 56 is retarded or controlled by the oscillatory movement of the escape lever disc 60 which is supported by a shaft 62. The escape lever disc 60 comprises a metal disc 60*a* which is press fitted onto protuberances 60*b* which extend from a cross member 60*c* which is molded integrally with the supporting shaft 62. The cross member 60*c* also has a pair of tooth like projections 60*d* which are intended to alternatively engage the teeth on the escape wheel 56.

The general configuration and the function of an escape wheel 56 and the escape lever disc 60 in a mechanical timer of this type are well-known to those skilled in the art. The rotation of the gear 56 is restrained and controlled by the escape lever disc which oscillates in a controlled fashion to release the gear one tooth at a time. The rate at which such release occurs is determined to some extent by the spacing between the axes of the shafts 36 and 62 as will be explained in greater detail below.

Figure 2:
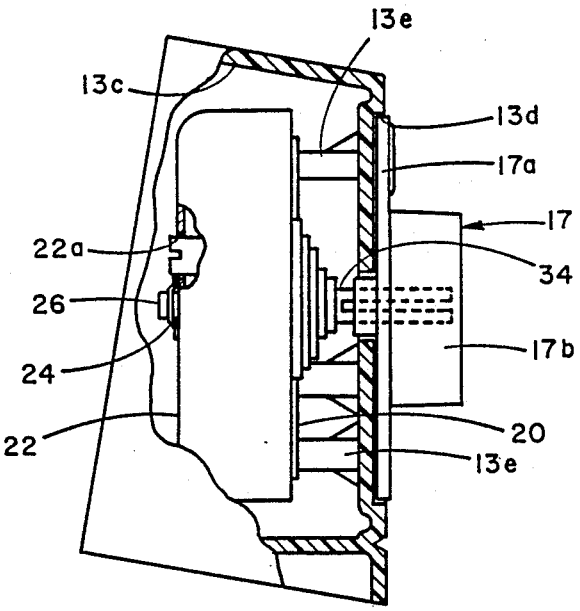
FIG. 2 is a side elevational view of the timer of FIG. 1 with portions thereof shown in section.

The set shaft 34 is journalled for rotation in the frame members 28 and 30 of the movement 20 as is evident from FIG. 3. The time set indicator 17 is received frictionally on the forward end of the set shaft 34 as is evident from FIG. 2. The timer 11 is powered by a helical coil spring 64 which is received within a recess 28*a* formed in the front frame member 28. The outer end of the spring 64 is secured to the interior of the recess 28*a* while the inner end is secured to the set shaft 34. The gear 38 is supported for relative rotation with respect to the set shaft 34 and drivingly related to the set shaft 34 by means of a friction clutch 66. As is common in timers of this sort, the clutch 66 allows the set shaft 34 to be rotated to the preselected time interval as shown by the indicia 15 while not rotating the gear 38. With the spring 64 being initially tensioned and further tensioned through this rotation, it tends to rotate the set shaft 34 back to its original zero position. This zero position is determined by the lever 68 which is secured to the set shaft 34 and restrains it from further rotation after it arrives at its zero position. Also shown in FIG. 3 is a lever 70 and spring 72 which are associated with the mechanism which operate on the bell member 22 to produce an audible alarm when the set shaft 34 is returned to the zero position.

In operation of the timer 11, the time set indicator 17 and the associated set shaft 34 are rotated to the selected time interval further tensioning the spring 64 which then tends to rotate the set shaft 34 back to the zero position. The friction clutch 66 is such that the spring 64 is not sufficiently powerful to rotate the set shaft 34 independently of the gear 38. Accordingly, the gear train 32 controls the rotation of the set shaft 34 by the spring 64 as it returns to the zero position. During this movement, escape lever disc 60 oscillates and controls the rate at which the set shaft 34 rotates. This rate is adjustable by means of a rotatable bearing 74 which is press fitted into an opening 30*a* formed in the rear frame member 30.

Figure 4:
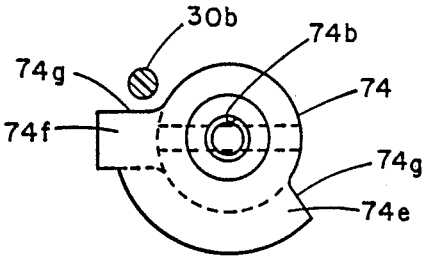
FIG. 4 is an axial view of the adjustable bearing for the escape lever disc.
Figure 5:
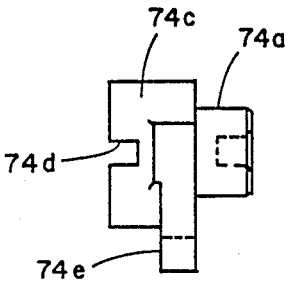
FIG. 5 is a side view of the adjustable bearing shown in FIG. 4.

As best shown in FIGS. 4 and 5, the rotatable bearing 74 has a reduced diameter portion 74*a* which is in press fitted engagement with the hole 30*a* of the frame member 30. Positioned in the portion 74*a* is an eccentrically disposed bearing opening 74*b* within which the shaft 62 for the escape lever disc 60 is supported. Because of the eccentric location of the hole 74b with respect to the portion 74*a*, rotation of the bearing 74 causes the spacing between the axes of the shaft 62 and the shaft 36 to be increased or decreased.

The bearing 74 is provided with a body portion 74c one side of which rests against the rear face of the frame member 30 and the other side of which is formed with a slot 74*d* which is provided to permit easy adjustment of the rotary position of the bearing 74. Also formed on the body portion 74*c* is a sector-shaped portion 74*e* and a radially extending stop portion 74*f*. The outer end of the bearing 74 extends through an opening 22*a* in the bell member 22 to provide the consumer an opportunity to calibrate the timer if it is required. Edges 74*g* of the sector-shaped portion 74*e* and stop portion 74*f* act against a pin 30b formed as part of the frame member 30 to prevent rotation of the bearing 74 beyond the designed adjustment range.

In that low-cost mechanical interval timers are frequently fabricated, making use of plastic gears, it is necessary to provide some means for calibrating a timer if it is to provide reasonably accurate timing. Plastic parts are conventionally made in molds having many cavities which differ slightly from one to another from a dimensioal standpoint. Therefore, if a large number of molded plastic gears are utilized at random to produce mechanical timers, there will be considerable variation between the timers and there is considerable need to calibrate each of the timers. This calibration is extremely costly and presents serious competitive problems in low-cost timers of this type. I have devised a novel assembly method which eliminates the need for individual calibration of all of the timers. By associating runs of parts from the same cavity and parts that have been made in a similar time period, I am able to provide groups of parts which are substantially identical from a dimensional standpoint. By calibrating one timer made from such a group of parts and establishing the proper spacing for the escape wheel and escape lever disc axes, it is possible to produce many timers which have essentially the same operating characteristics as the one which was calibrated.

In practicing this method, I select an initial production timer made from the grouped sets of parts and calibrate this timer by adjusting the bearing 74 rotatably and measuring the performance against an accurate standard. Once the position of the bearing 74 has been established to obtain the same timing rate as the standard, the angular position of the bearing 74 is measured for use in setting the bearings in the other timers assembled from that group of selected sets of parts.

Figure 6:
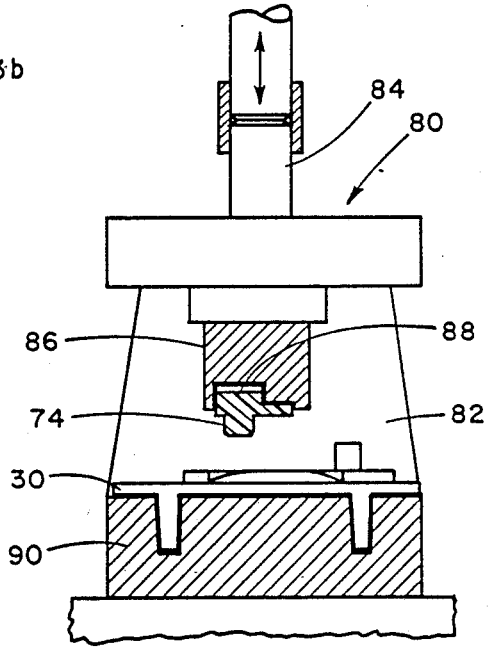
FIG. 6 is a front elevational view of a machine used in practicing the method of my invention.

In producing the timers with this corresponding bearing position, I employ an assembly press 80, as shown in FIG. 6, to press the rotatable bearing 74 into the rear frame member 30. The press 80 includes a frame 82 which supports a vertically mounted arbor 84 which, at its lower end, carries a rotatably adjustable support fixture 86. The support fixture 86 may be locked in any selected angular position. There is a blade 88 on the head 86 which is intended to be received within the slot 74*d* in the bearing 74. The bearing 74 is shown in FIG. 6 as positioned on the head 86 in engagement with the blade 88. In accordance with the method of my invention, suitable indicia are provided to orient the blade 88 in whatever rotational position is required to correspond to the of the bearing 74 in the calibrated timer. The press 80 further includes jig 90 which receives and supports the rear bearing member 30 in a particular orientation and in position to receive the rotatable bearing 74.

With the frame member 30 assembled in the jig 90 and the rotatable bearing 74 positioned in the head 86, the operator actuates a suitable air cylinder which press fits the bearing 74 into the frame member 30 oriented in the desired angular position to correspond to that of the calibrated timer. After the bearing 74 has been assembled to the frame 30, the assembly of the remainder of the movement 20 proceeds. The various gear supporting shafts, the set shaft 34 and the parts associated with the ringing mechanism, are installed and the front frame member 28 is secured to the rear frame member 30 by screws 92 as shown in FIG. 3.

After the initial timer has been calibrated, the plastic gears used in the later assemblies correspond to the grouped sets which match the gears used in the initial assembly of the calibrated timer used to establish the position of the bearing 74 for all of the timers in this production run. As a result of using this method, I have provided a simple and inexpensive means of producing uniform interval timers which correspond to a calibrated standard. The method of calibrating and applying the calibration to the other timers in the group is simple and effective through the use of the press fitted rotatable bearing 74. The bearing 74 used in the factory adjustment is then also available if the user requires further calibration during the life of the unit.

What is claimed as new and desired to be secured by Letters Patent of the United States is:

1. An interval timer of the type having a spring which is manually tensioned when the timer is set and having an escapement gear train through which said spring drives an escape wheel controlled by an escape lever disc, the improvement comprising a pair of plastic frame members in which a plurality of gears forming said gear train are journalled, a shaft supporting one end of said escape lever disc, a rotatable bearing supporting one end of said escape lever disc shaft, said bearing being press fitted into a circular opening in one of said frame members and an eccentric bearing hole in said bearing whereby rotation of said bearing in said opening changes the spacing between the axes of said escape wheel and said escape lever disc.

2. The combination of claim 1 wherein said rotatable bearing is formed with indicia permitting assembly to said one frame member to provide a predetermined spacing between said axes of said escape wheel and said escape lever disc.

3. The combination of claim 2 wherein said rotatable bearing comprises a cylindrical mounting portion and a coaxial body portion, said mounting portion including said eccentric bearing hole and being press fitted into a circular opening in said one frame member, said body portion having a slot extending across the end remote from said mounting portion.

4. The combination of claim 2 wherein said timer includes a housing enclosing said frame members and said escapement gear train, manually actuable time setting means pivotally mounted on a set shaft extending exteriorly of said housing and connected to said gear train to tension said spring and set said gear train for a selected time interval, said housing being formed with interval time indicia surrounding said set shaft, said time setting means comprising a transparent disc overlying said indicia and having a diametrically extending protuberance on its outer surface to permit manual actuation.

5. The combination of claim 4 wherein said transparent disc is formed with a radial pointer which overlies said indicia to establish the time settings for said timer.

6. The combination of claim 5 wherein said transparent disc is provided with a magnifying portion aligned with said pointer to provide a magnified image of said indicia.

7. The combination of claim 1 wherein said timer includes a housing enclosing said frame members and said escapement gear train, a manually actuable time setting means mounted on a set shaft extending exteriorly of said housing, said housing having an opening aligned with said bearing, said bearing being manually rotatable to provide user calibration of said timer.

* * * * *